US005118113A

United States Patent [19]

Ahlers et al.

[11] Patent Number: 5,118,113

[45] Date of Patent: Jun. 2, 1992

[54] BOARD GAME

[76] Inventors: Glenn M. Ahlers; Alicia A. Ahlers, both of 4007 Taylor Blvd., Louisville, Ky. 40215

[21] Appl. No.: 660,392

[22] Filed: Feb. 25, 1991

[51] Int. Cl.[5] ..... A63F 3/00

[52] U.S. Cl. ..... 273/243

[58] Field of Search ..... 273/243, 248, 249, 280

[56] References Cited

U.S. PATENT DOCUMENTS

| | | | |
|---|---|---|---|
| 1,442,165 | 1/1923 | McKay | 273/243 X |
| 3,704,018 | 11/1972 | Fyanes | 273/243 |
| 3,888,490 | 6/1975 | Kline | 273/243 |
| 3,939,578 | 2/1976 | Coffey | 273/243 X |
| 4,214,755 | 7/1980 | Wysocki | 273/243 |
| 4,244,579 | 1/1981 | Campos | 273/243 |
| 4,557,485 | 12/1985 | Lardon | 273/249 X |
| 4,671,516 | 6/1987 | Lizzola | 273/243 X |
| 4,815,976 | 3/1989 | Krane | 273/243 X |
| 4,855,347 | 10/1977 | Kreischer | 273/243 |
| 4,907,807 | 3/1990 | Lee | 273/243 X |

*Primary Examiner*—Edward M. Coven
*Assistant Examiner*—William E. Stoll
*Attorney, Agent, or Firm*—Charles G. Lamb

[57] ABSTRACT

A game apparatus includes a circular game board having a movement path for game pieces along which a player moves playing pieces. The movement path is divided into separate spaces having specific indicia designations therein. The designations indicate rewards or penalties for a player whose playing piece lands in a space. The game apparatus also includes action cards disposed in stacks, each card indicating an activity to which a player is subjected. The game apparatus further includes a random number generating device, such as a die, a pair of dice, or the like to determine the movement of the playing pieces along the movement path.

6 Claims, 5 Drawing Sheets

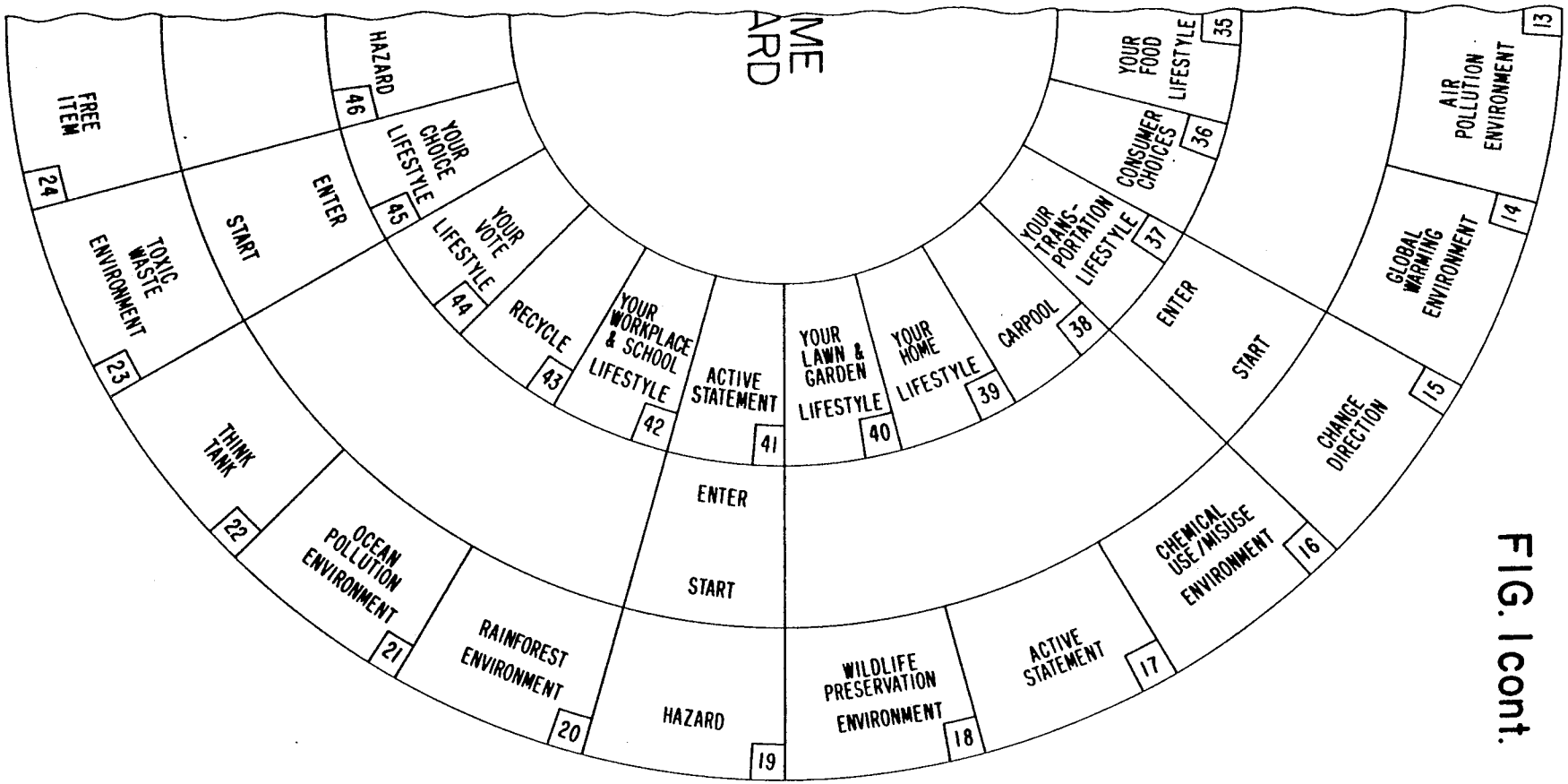
FIG. 1cont.

| 201 | 202 |
|---|---|
| ENVIRONMENT CARD | 1. AIR POLLUTION<br>IF YOU SMOKE AND AND AREN'T WILLING TO QUIT, LOSE ONE TURN. IF YOU DON'T SMOKE OR ARE WILLING TO TRY QUITTING, THEN RECIEVE ONE ITEM. |
| 1. AIR POLLUTION<br>COMPLETE TASK | 2. GLOBAL WARMING<br>THREE MOLECULES OF OXEGEN TOGHETHER FORMS WHAT? |
| 2. GLOBAL WARMING<br>OZONE | 3. CHEMICAL USE<br>YOU FOUND OUT THE WATER YOU USED TO FEED YOUR APPLE TREES WAS CONTAMINATED HEAVILY WITH PESTICIDES. WHAT SHOULD YOU DO? |
| 3. CHEMICAL USE<br>HAVE TESTED FOR CONTAMINATION | 4. WILDLIFE PRESERVATION<br>WHAT IS THE LARGEST DANGER THAT FACES DOLPHINS AND PORPOISES? |
| 4. WILDLIFE PRESERVATION<br>COMMERCIAL FISHING TRAWLERS | 5. RAIN FORESTS<br>YOU STOPPED EATING IMPORTED BEEF THAT WAS RAISED WHERE RAINFOREST ONCE STOOD YOU MAY ROLL AGAIN. |
| 5. RAIN FORESTS<br>COMPLETE ACTION | 6. OCEAN POLLUTION<br>A BABY SEAL DIED FROM STRANGULATION DUE TO A 6 PACK RING CAUGHT AROUND HIS NECK. YOU CLIP YOUR RINGS HOWEVER. RECIEVE ONE ITEM. |
| 6. OCEAN POLLUTION<br>COMPLETE ACTION | 7. TOXIC WASTE<br>YOU FOUND A TOXIC WASTE SITE IS A NEARBY WOODED AREA, WHAT SHOULD BE THE FIRST THING YOU SHOULD DO. |
| 7. TOXIC WASTE<br>CALL A LOCAL ENVIRONMENTAL AGENCY TO INVESTIGATE. | |

FIG. 2

| 301 | 302 |
|---|---|
| LIFESTYLE CARD | |
| COMPOSTING | NAME ONE ALTERNATIVE TO DISPOSING OF KITCHEN FOOD SCRAPS |
| YOU MAY ROLL AGAIN | YOU JUST TUNED UP YOUR CAR |
| YOU MAY ROLL AGAIN | YOU TURN DOWN YOUR THERMASTAT AT NIGHT AND PILE ON BLANKETS |
| INSULATES HOUSE AND SAVES HEAT | WHAT EFFECT WOULD PLANTING BUSHES AROUND THE BASE OF YOUR HOUSE HAVE ON YOUR HOME'S ENERGY AND WHY |
| RECYCLE ONE ITEM | YOU HAVE WRITTEN A PETITION THAT ENCOURAGES YOUR SCHOOL TO PURCHASE REUSABLE PLATES INSTEAD OF DISPOSABLE ONES. |
| RECYCLE ONE ITEM | THE SENATE WILL BE VOTING ON A CRITICAL ENVIRONMENTAL BILL SOON. YOU CALL YOUR SENATOR AND TELL HIM HOW YOU WOULD LIKE HIM TO VOTE. |
| RECYCLE ONE ITEM | AT THE SUPERMARKET TODAY YOU BOUGHT BULK FOODS TO SAVE ON PACKAGING |

FIG. 3

| 402 LITTER | 404 LAND FILL | 406 INCINERATOR | 408 TOKEN CARD | 410 |
|---|---|---|---|---|
| RETURN OR REUSE ONE NON - RECYCLABLE ITEM DURING PLAY OF YOUR TURN | TAKE YOUR USED MOTOR OIL TO THE GAS STATION NEXT TIME. LOSE ONE TURN. | YOU HAVE INCINERATED YOUR PLASTIC JUGS, TELL THE OTHER PLAYERS YOU ARE SORRY AND WHAT YOU SHOULD HAVE DONE WITH THEM. | THIS CARD ENABLES YOU TO RETURN OR RE-USE ONE RECYCLEABLE ITEM DURING PLAY OF YOUR TURN. | HAZARD CARD |

FIG. 4

| 501 ACTIVE STATEMENT | 502 ACTIVE STATEMENT |
|---|---|
| CHOOSE AN ENVIRONMENTAL ISSUE. ROLL AGAIN IF YOU CAN GIVE A CAUSE AND ITS EFFECT ON THE EARTH. | NAME A HOUSEHOLD CHEMICAL OF HAZARD WASTE AND ROLL AGAIN ONLY IF YOU CAN HAVE A SAFE ALTERNATIVE. |

FIG. 5

| 602 | 604 | 606 | 608 |
|---|---|---|---|
| NEWSPAPER | ALUMINUM CANS | GLASS BOTTLE | PLASTIC JUG |
| COLORED GLASS | CORRUGATED CARDBOARD | STYROFOAM | PAINT |
| 610 | 612 | 614 | 616 |

FIG. 6

BOARD GAME

BACKGROUND OF THE INVENTION

The present invention relates to a board game and more particularly to a board game that offers a combination of skill and chance in attempting to win the game.

The board game of the present invention in general comprises a playing board having concentric paths of movement for playing pieces divided into spaces along which playing pieces are moved in accordance with the numbers shown on the probability determining device and in accordance with other instructions which might pertain to a certain space on which the playing piece lands. A plurality of stacks of action cards are also supplied, the cards being drawn by the players from time to time to receive specific instructions for action in conformity with certain playing spaces on which the respective players playing piece may land.

A particular feature of the present invention is to be found in the fact that the game is a representation of an ecological system. The skill in the game reflects the progress of the players in the accumulation of re-cyclable products and then recycle the products. The ecological or environmental system is divided into simulated components of different ecological situations and decisions relating to an individual's involvement in the system. Each of the aforementioned components of the ecological system is simulated in the player's drawing from a stack of cards which relate to each of the simulated components of the system.

Although allowing for unlimited skill toward optimum play, the game is, nevertheless, quite easily learned and can be a source of entertainment and education. Thus, the game of the present invention consists in developing a better understanding of the basic ecological structure in which we live and the inherent factors effecting the same.

SUMMARY OF THE INVENTION

It is an object of the present invention to provide a novel game.

It is another object of the present invention to provide a novel game involving skill, entertainment and education.

It is still another object of the present invention to provide a game associated with the different factors relating to our basic environmental situation.

Various other features of the present invention will become obvious to those skilled in the art upon reading the disclosure set forth hereinafter.

More particularly, the present invention relates to a game apparatus comprising a circular game board having a movement path for playing pieces imprinted thereon around the marginal edge portions of the board, the movement path being divided into separate indicia bearing spaces having specific indicia designations thereon, the designations being indicative of rewards or penalties for players of the game. Aforementioned movement path shall have both outer and inner patterns comprising of separate indicia as set forth hereinafter.

Various playing pieces, one for each player of the game, each playing piece being destinctively different so as to prevent confusion between each player's playing piece shall be provided, said pieces being randomly chosen from various household items; a plurality of stacks of action cards, each of the cards in a stack indicating a particular form of activity to which a player may be subjected; a probability determining device, preferably a wooden die, adapted to be used in conjunction with the playing pieces to determine movement of the playing pieces along the board.

It is to be understood that the description of the examples of the present invention given hereinafter are not by way of limitation. Various modifications within the scope of the present invention will occur to those skilled in the art upon reading the disclosure set forth hereinafter.

BRIEF DESCRIPTION OF THE DRAWINGS

A better understanding of the invention will be had upon reference to the following description in conjunction with the appended drawings, wherein:

FIG. 2 shows the designations on the respective cards forming a pack of Environment cards that is a part of the present invention; the cards purposefully designated to be used on Environment playing squares when landed thereon;

FIG. 3 shows the designations on the respective cards forming a pack of Lifestyle cards that is a part of the present invention;

FIG. 4 shows the designations on the respective cards forming a pack of Hazard cards that is a part of the present invention;

FIG. 5 shows an example of the information included in the designations on the respective gaming space identified in FIG. 1 as "Active Statements"; and, FIG. 6 shows various playing pieces of the game apparatus of the present invention.

DETAILED DESCRIPTION OF THE PREFERRED EMBODIMENT

Figure 1:
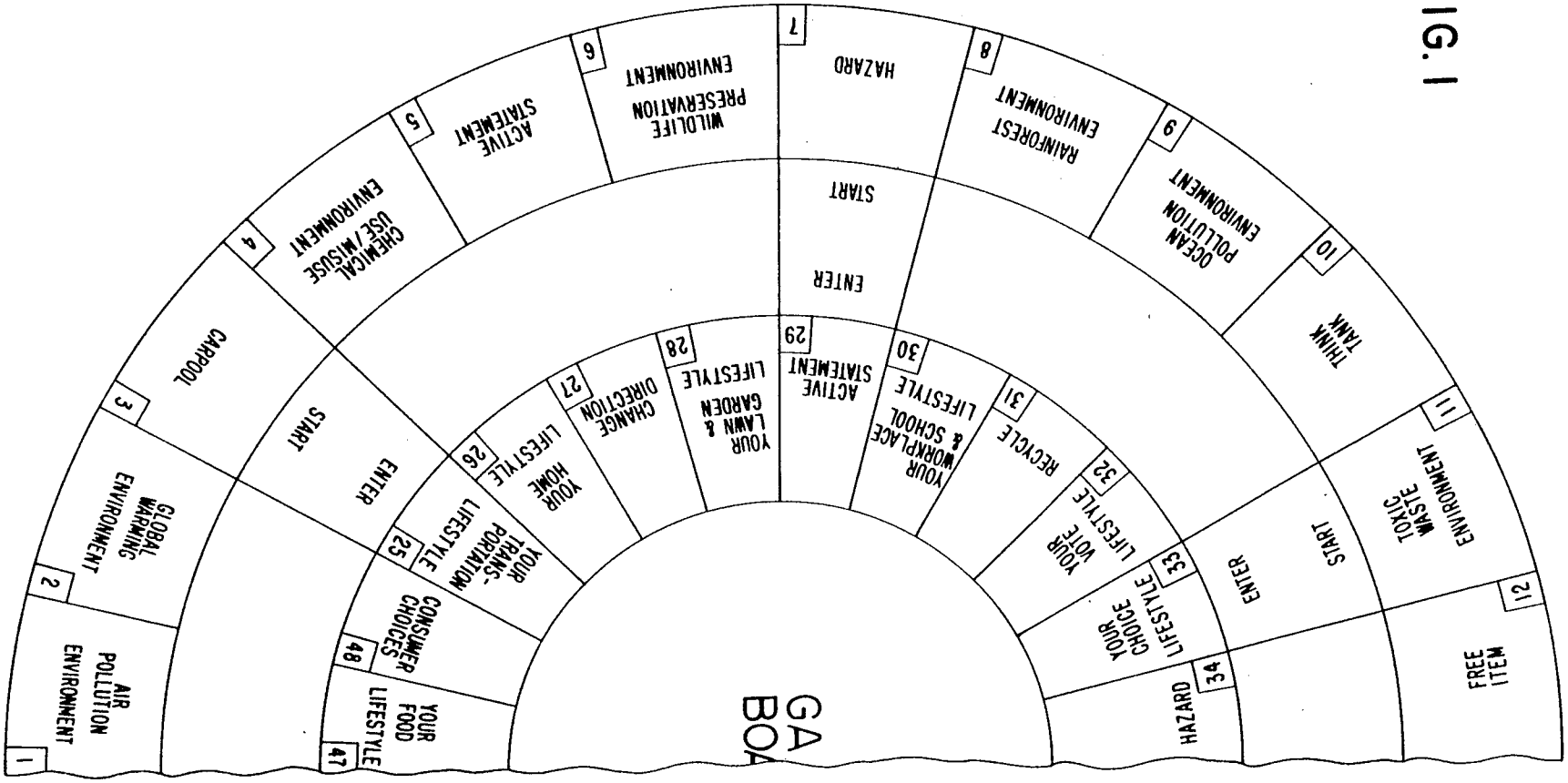
FIG. 1 shows one preferred playing board having a playing piece movement path divided into spaces according to the present invention.

Referring now to FIG. 1, the board game includes a playing board, generally denoted as the numeral 50, which is of substantially circular configuration. The board 50 may be stiff and adapted to be folded together according to conventional practices and consists of recycled paper or cardboard material which can be laid upon a flat surface, such as a table top, when the game is being played. Thus, it will be understood that the term "board" includes only a stiff, self-supporting recycled paper or cardboard member.

The playing board 50 comprises a first or outer circular peripheral playing piece movement path, generally denoted as the numeral 52, and a second or inner circular playing piece movement path, generally denoted as the numeral 54, smaller in circumference than the first path 52 and concentrically located relative to the first path 52. The first or outer circular movement path 52 is directed into a plurality of spaces, for example twenty-four spaces, disposed in a side-by-side relation to form the continuous first path 52 completely about the board, and are numbered in sequence 1 through 24 in a clockwise direction along the first circular path 52. The second or inner circular movement path 54 is divided into a like plurality of spaces, for example twenty-four spaces, disposed in side-by-side relationship to form the continuous second path 54 completely about the board and numbered in sequence 25 through 48. Each of the spaces 1 through 24 of the first or outer path 52 is in radial alignment with a different one of the spaces 25 through 48 of the second or inner path 54. The numbers 1 through 48 of the spaces of the first and second paths 52 and 54, respectively, are printed in relatively small rectangular shaped boxes at the bottom of each space. In addition, the playing board 50 includes a plurality of, for example six, "enter start" spaces 56–61, circumferentially spaced apart from each other in the circular space between the first circular path 52 and second circular path 54. Each "enter start" space 56–61 is in alignment with one of the spaces 1 through 24 of the first path 52 and the one of the spaces 25 through 48 of the second path 54 in radial alignment with that space of the first path 52. For example, as shown, Enter/Start space 56 is in radial alignment with and extends between space 3 of the first path 52 and space 25 of the second path 54, Enter/Start space 57 is in radial alignment with and extends between space 7 of the first path 52 and space 29 of the second path 54; Enter/Start space 58 is in radial alignment with and extends between space 11 of the first path 52 and space 33 of the second path; Enter/Start space 59 is in radial alignment with and extends between space 15 of the first path 52 and space 37 of the second path 54; Enter/Start space 60 is in radial alignment with and extends between space 19 of the first path 52 and space 41 of the second path 54; and, Enter/Start space 61 is in radial alignment with and extends between space 23 of the first path 52 and space 45 of the second path 54.

The board game 50 further includes stacks of cards which are marked with categories in conformity with the legends shown in FIGS. 2–4. For example, the board game includes three separate stacks of cards, the first stack is designated Environment (see FIG. 2), the second stack is designated Lifestyle (see FIG. 3), and the third stack is designated Hazard (see FIG. 4).

With continued reference to FIG. 1, each of the spaces 1 through 24 of the first path 52 and each of the spaces 25 through 48 of the second path 54 are marked with various self-explanatory player tasks to be completed by the player whose playing piece lands on that space during a turn of play, or marked with a category corresponding to the stacks of cards mentioned above. For example, spaces 1, 2, 4, 6, 8, 9, 11, 13, 14, 16, 18, 20, 21, and 23 of the first path 52 are marked with the card category Environment; spaces 25, 26, 28, 32, 33, 35, 37, 39, 40, 42, 44, 45, and 47 of the second path 54 are marked with the card category Lifestyles; and, spaces 7, 14 of the first path 52 and spaces 34, 46 of the second path 54 are marked with the card category Hazard.

When the playing piece of any player lands on a space 1 through 48, the appropriate action to be taken by the player is indicated on that space, which as mentioned above, includes instructions either to draw a card from a pack of designated cards and follow the instruction thereon, or to complete the task designated or marked in that space. The player must follow the instructions on the drawn card or complete the task during that playing turn. For example, when the player lands on a space marked with a card category, the player draws a card from the stack of cards relating to that category. For example, when a player lands on any of the spaces designated by the numerals 1, 2, 4, 6, 8, 9, 11, 13, 14, 16, 18, 20, 21, or 23, the player draws a card from the first stack designated Environment.

Turning to FIG. 2, each of the Environmental cards in the stack bears a legend recognizing the environment. As shown in FIG. 2, each Environmental card contains seven designated instructions such as questions, tasks, or actions related to various environmental categories or concerns such as air pollution, global warning, chemical use, wild life preservation, rain forests, ocean pollution, toxic waste and the like. When a player's playing piece lands on a space 1, 2, 4, 6, 8, 9, 11, 13, 14, 16, 18, 20, 21, or 23, that player draws an Environmental card and follows the instruction thereon which relates to the environmental indicia thereon. For example, the environmental indicia on the space may be air pollution, for which the player will follow the instruction on the Environmental card for the section identified as air pollution. In FIG. 2, the numeral 201 illustrates the back side of one Environmental card and the numeral 202 illustrates the face side of the same card. Only one designated instruction on a card shall be used. It is required that the player complete only the appropriately designated instruction, that is, question, task, or action to complete their turn. Upon completion or correctly answering the appropriate question or completing the required task or action, the player may then acquire a game piece (1 of 7) necessary to proceed with the game. In the event that the player does not successfully complete the question, task, or action on the card, the player does not acquire any game pieces and the turn proceeds to the next appropriate player.

Referring to FIG. 3, each Lifestyle card of the second stack bears the legend concerning the lifestyle. As shown in FIG. 3, each Lifestyle card contains seven instructions, such as activities, tasks, or questions related to various lifestyles. When a player's playing piece lands on a space 25, 26, 28, 30, 32, 33, 35, 37, 39, 40, 42, 44, 45 or 47, that player draws a Lifestyle card and follows the instructions thereon which relates the lifestyle indicia thereon. For example, the lifestyle indicia on the space may be a picture that corresponds to an identical picture on one of seven sections of the card, for which the player will follow the instruction on the Lifestyle card identified by the picture. In FIG. 3, the numeral 301 illustrates the back side of one Lifestyle card and the numeral 302 illustrates the front side of the same card. Only one designated instruction on a card shall be used.

Referring to FIG. 4, each of the Hazard cards in the third stack bears a legend recognizing a hazard, for example an environmental hazard. As shown in FIG. 4, each of the cards in the Hazard category relates to a different specific environmental hazard. As shown, each Hazard card contains an instruction such as an action and direction statement related to an environmental hazard. For example, the face side of card 402 relates to litter, the face side of card 404 to a land fill, the face side of card 406 to an incinerator, and the face side of card 408 to a token card, directing the player to perform corrective action in order for them to complete their turn. The action may be, for example, a penalty which will inhibit the player in his efforts to complete the objective of the game. The numeral 410 shows one typical back side of the hazard cards.

In FIG. 1, the spaces 5, 17, 29, 41 of the game board 50 are marked with the task denoted as an Active Statement. There are no cards corresponding to this category. The Active Statements are various instructions such as, phrases and directions which appear on the gaming space 5, 17, 29, 41 and are able to be completed during the player's turn. FIG. 5 illustrates two examples of Active Statements that are set forth in two of the Active Statement spaces in FIG. 1. One such Active Statement is identified by numeral 501 and a second Active Statement space is identified by numeral 502. When a player's game piece lands on one of these Active Statement spaces 5, 17, 29, 41, the player is to respond to the phrase or direction on that space. The player will be rewarded for completion of the Active Statement by being allowed to roll for another play. The penalty for non-completion is to not be able to take the rewarded turn.

In FIG. 1, the spaces 12 and 24 of the game board 50 are marked with the task denoted as Free Item. Again, there are no cards corresponding to this category. When a player's game piece lands on one of these Free Item spaces 12, 24, the player is allowed to obtain a gaming piece in order to complete the objective of the game. (Gaming pieces are shown in FIG. 6.) No penalties are associated with these Free Item spaces. Any player retaining any number of gaming pieces is still required to obtain an additional piece at the end of their roll, if their gaming piece lands on one of these Free Item spaces 12, 24.

In FIG. 1, the spaces 10 and 22 of the game board 50 are marked with the task denoted as Think Tank. There are no cards corresponding to this category. When a player's game piece lands on one of these Think Tank spaces 10, 22, the player is required to generate an idea concerning an environmental problem and a creative solution concerning the problem. The idea generated by the player will then be voted upon and rated by the other players. The player must adhere to the voted decision of the other players set forth in the rules of play based upon the ratings guide set forth in the rules of play discussed hereinafter.

In FIG. 1, the spaces 3 and 38 of the game board 50 are marked with the task denoted as Car Pool. There are no cards corresponding to this category. When a player's game piece lands on one of these Car Pool spaces 3, 38, it is required that the player immediately join the next player on that player's gaming space, and complete their turn with them exactly as dictated by the instructions of that next player's space by performing any tasks or penalties required thereby. The duration of play will last only as long as the rolling player has control of the board. When the play is returned to the next person, individuality resumes and each player continues on their own turn.

In FIG. 1, the spaces 15 and 27 of the game board 50 are marked with the task denoted as Change Direction. There are no cards corresponding to this category. When a player's game piece lands on a Change Direction space 15, 27, the player is required to roll the die an additional time to determine the number of spaces used during the play. The player will then move in a counterclockwise direction equal to the number of spaces indicated by the die. This penalty will only affect the player's one turn and the player will resume a clockwise direction on their next play.

In FIG. 1, the spaces 36 and 48 of the game board 50 are marked with the task denoted as Consumer Choices. There are no cards corresponding to this category. When a player's game piece lands on these Consumer Choices spaces 36 and 48, the player is required to generate an answer which relates to an item in the player's household which is purchased on a frequent basis. Remaining players will then vote as set forth in the rules of play discussed hereinafter, and appropriate action must be taken by the player as also set forth in that rating system in the rules of play.

In FIG. 1, the spaces 31 and 43 of the game board 50 are marked with the task denoted as Recycle. There are no cards corresponding to this category. When a player's game piece lands on one of these Recycle spaces 31, 43, the player is allowed to recycle or "turn in" a gaming piece having indicia denoting a recyclable item. These Recycle spaces 31 and 43 allow the player landing thereon to accomplish this without performing any tasks set forth by the gaming board, thus assisting the player to achieve the player's goal of winning the game. Only a recyclable game piece shall be affected as set forth in the rules of play. All non-recyclable game pieces shall be retained by the player during his/her turn on this gaming space.

In FIG. 1, the spaces 56, 57, 58, 59, 60, and 61 include the phrase Start/Enter therein. These Start/Enter spaces 56, 57, 58, 59, 60, and 61 are used for the players to gain access to both the first path 52 and second path 54 as set forth in the rules of play to be discussed hereinafter. These Start/Enter spaces hold no penalties or rewards for the player, and are only used to move between the first path 52 and second path 54.

With reference to FIG. 6, the game pieces of the game board 50 are examples of items and materials found in the environment. Some of these items and materials are recyclable or biodegradable. The game pieces shown in FIG. 6 are cards with appropriate words thereon exemplifying the items and materials they represent. For example, the card identified by the numeral 602 includes the word "Newspaper" thereon; the card identified by the numeral 604 includes the words "Aluminum Cans"; card 606 includes "Glass Bottle"; card 608 includes "Plastic Jug"; card 610 includes "Colored Glass"; card 612 includes "Corrugated Cardboard"; card 614 includes "Styrofoam"; and, card 616 includes "Paint". Even though game pieces are shown as cards with items and materials found in the environment inscribed thereon, other illustrative replicas of the same or other items and materials found in the environment may be utilized.

Rules of Play for Two to Six Individuals or Teams

A. Each player provides their own playing piece or replica thereof as currently found in their household. A playing piece suggestion list may also be provided. Each playing piece selected shall then be placed on a different one of the Start/Enter spaces 56, 57, 58, 59, 60, 61.

B. All stacks of environmental and lifestyle cards are placed face up and hazard cards are placed face down near to, but not covering, any part of the designated area known as the Game Board 50 as indicated in FIG. 1.

C. To start play:

Each player rolls the die to determine who starts the roll of play. The player with the highest roll starts the play and play continues in a clockwise motion from player to player. After rolling, the player starting the game moves his playing piece from the Start/Enter space 56, 57, 58, 59, 60, and 61 and onto the first or outer path 52 and moves the gaming piece in a clockwise direction thereon from a Start/Enter space 56, 57, 58, 59, 60, 61 as seen in FIG. 1, the number of spaces indicated by the die. The player then takes a card or performs the appropriate action indicated by the space upon which his piece has landed. If a card is to be drawn, the player draws the appropriate card and follows the instructions thereon or completes a task if that is required. Play turn passes clockwise to each player taking his turn as above and moving his piece accordingly. Each gaming piece that the players will encounter contains specific individualities particular to that player.

The following descriptions are detailed as to the appropriate action necessary of each player to complete their turn should they land on any specific space. Each player is required to obtain seven recyclable items as shown in FIG. 6 before he can move his game piece to the second or inner path 54 of the game board 50. Each player must use caution not to obtain any items not able to be recycled. Each player must also be aware that the focus of the game is to complete the recycling of their collected pieces while their game piece is in the second or inner path 54.

The player who accomplishes this task first is then declared the winner and the game comes to an end. Each gaming space along with the necessary details affecting each player are listed as follows.

Outer or First Path of Spaces

Start—

A different one of the Start/Enter spaces 56, 57, 58, 59, 60, 61 is used for each player or team of players as a reference point to move their gaming piece to the first or outer path 52. The gaming piece that leaves the Start-/Enter space immediately joins the motion of play in a clockwise direction of the first path 52.

Environment—

Each player whose gaming piece lands on an Environment space 1, 2, 4, 6, 8, 9, 11, 13, 14, 16, 18, 20, 21, 23 is then required to draw an Environment card. Each card is appropriately designated as in FIG. 2. Each Environment space is generally designated by a colored border, however, each space has a specific focus. On each Environment card contains categories relating to the focus of that Environmental space. When a player draws an Environment card, the player then reads the appropriate designated question or statement on the face side which relates to the designation of the space he has landed upon, which may include descriptions or pictures of objects thereof. After taking an Environment card, the player will either answer an appropriate question, perform a task, or comply with a statement on the face side of the card. If the designated category requires an answer, the player must give the answer before he turns the card over. If the player is successful in answering correctly, they will receive a gaming piece necessary to complete the first or outer path 52. If the player is told to complete a task such as "roll again" or a "go to", then the player simply completes the task without obtaining a collectable piece.

Car Pool—

Each player landing on a Car Pool space 3 immediately joins the player who rolls next and lands on the Car Pool space 3. These players then move their gaming pieces jointly and together completing all tasks in that turn. Should a "roll again" or "lose one turn" or a "reverse direction" or any other task be encountered, both Car Pool joined players must complete the task. The Car Pool condition of the game may be completed regardless of the number of players. For example, player "A" lands on a Car Pool space 3, and then moves to Player "B" space, who is currently on the Environment space 23. Player "B" then rolls a 4 on the die and both Players "A" and "B" then move to the next player's space on their path 52. Should there be no other players on path 52, or Players "A" and "B" are the only players in the game, the players "A" and "B" will then roll the die separately to continue the game from that point on. The Car Pool space of the game, when used correctly, encourages cooperative use of resources as well as encouraging the collective concern for obtaining the objective of the game.

Active Statement—

Upon landing upon an Active Statement space 5, 17, the player must verbally acknowledge to the other players the information regarding that space. Each of the Active Statement spaces have a directive statement and the player will have to tell the other players what they are doing to adhere to that statement. Successfully responding to the directive statement allows the player to roll the die again.

Think Tank—

When a player lands on a Think Tank space 10, 22, the player will address an environmental problem and attempt to create a solution to that particular problem. If the player is unable to complete this task, the player will lose one turn on their next play. Once the player successfully solves the environmental problem, the other players will rate the solution in the following manner. A point system consisting of 1 to 3 being a negative or penalty score and will result in the player losing a recyclable piece; a score of 4 to 7 allows the play to move to the next player; and, a score of 8 to 10 allows the player to gain one recyclable piece. These scoring points will be assessed by the other players. If the other players are unable to come to an agreement on a score, each of the other players will individually rate the solution from 1 to 10. The score points will be added, and an average will be taken by dividing the sumed score points by the number of players voting. This final point score will then be rated in the above-mentioned manner.

Hazard—

When a player lands on a Hazard space 7, 19, the player takes a card from the Hazard deck of cards. The player will read the card out loud and complete the penalty task set forth on the card. Reusable positive cards when drawn from the Hazard deck may be retained until needed. If a Token card is drawn, the Token card can only be used by a player when his gaming piece is in the second or inner path 54 as hereinafter explained.

Free Item—

When a Free Item space 12, 24 is landed upon, the player will obtain one recyclable item as shown in FIG. 6 without performing any necessary tasks. The acquired recyclable item must be accepted by the player regardless of the number of recyclable items already in that player's possession.

Change Direction—

When a player lands on a Change Direction space 15, 17, the player then immediately rolls the die again and moves his gaming piece in a counter-clockwise direction of the path 52 equal to the number rolled on the die. The player must then complete all tasks of the space then landed upon. This penalty only lasts for one turn and the player resumes a clockwise motion on his next roll.

Inner or Second Path of Spaces

Enter—

The Enter/Start space 56, 58, 59, 60, 61 functions both as the start position and serves as a reference point in which to move the gaming piece from the path 52 to the second path 54. The player must count the Enter/-Start space 56, 58, 59, 60, 61 on the way from the first path 52 to the second path 54, but may not land on it. Once entering the second path 54, the motion of play resumes in a clockwise pattern.

Car Pool—

Each person landing on a Car Pool space 38 immediately joins the player who rolls the die next and lands on the Car Pool space 38. These players then move their gaming pieces jointly and together complete all the tasks in that turn. Should a "roll again" or "lose one turn", or a "reverse direction", or any other task be encountered, both Car Pool joined players must complete the task. The Car Pool condition of the game must be completed regardless of the number of players.

Lifestyle—

Each player whose gaming piece lands on a Lifestyle space 25, 26, 28, 30, 32, 33, 35, 37, 39, 40, 42, 44, 46, 47 is required to draw a Lifestyle card. Each Lifestyle space is generally designated by a colored border, however, each space has a specific focus. On each Lifestyle card are categories relating to the focus of that Lifestyle space. When a player draws a Lifestyle card, the player reads the appropriately designated question or statement on the face side of the card which relates to the pictorial or other designation of that Lifestyle space the player lands upon. After taking a Lifestyle card, the player will either answer an appropriate question, perform a task, or comply with a statement thereon. If the category requires an answer, the player must answer the question before turning the card over. If the player successfully performs the task set forth on the Lifestyle card or answer the question, that player is allowed to recycle or compost one of their gaming pieces necessary to complete the game. If the player is told to perform a task such as "roll again" or "go to", then the player simply completes the task without returning an item.

Active Statement—

Upon landing upon an Active Statement space 29, 41, the player must verbally acknowledge to the other players the information regarding that space. Active Statement spaces have a directive statement and the player will have to tell the other players what they are doing to adhere to that statement. Successfully responding to the direction statement allows the player to roll the die again.

Change Direction—

When a player lands on a Change Direction space 27, the player then immediately rolls the die again and moves their gaming piece in a counter-clockwise direction of the path 54 equal to the number rolled on the die. The player must then complete all tasks of the space landed upon. This penalty lasts for one turn and the player resumes a clockwise motion on their next roll of the die.

Hazard—

When a player lands on a Hazard space 34, 46, the player takes a card from from the Hazard stack of cards. The player will read the card out loud and complete the penalty task set forth on the card. Reusable token cards or positive cards when drawn from the Hazard deck may be retained until needed. A Token Card drawn from the Hazard card stack during a previous turn while the playing piece was moved in the first path 52 or second path 54 may be used at any time during the player's turn while in the second path 54, and allows the player to reuse or turn in a non-recyclable item in their possession.

Recycle—

When a player lands upon a Recycle space, recyclable items may be returned without any tasks necessary. It is the object of the game that when within the inner circle, the player returns all items in that player's possession.

Consumer Choices—

When a player lands on a Consumer Choices space 36, 48, the player will verbally communicate to the other players a product that they purchase on a frequent (weekly/monthly) basis. If the player is unable to do this, a loss of one turn will result upon the player's next turn. Once given the product, the other players will rate the product in accordance with the following directions:

A scoring system consisting of 1 to 3 points being a negative or penalty score will cause a player to gain one recyclable gaming piece; 4 to 7 points allows play to resume by the next player; and 8 to 10 points, being a positive score, allows the player to recycle or return one gaming piece. Questions may be asked by the other players and discussion is encouraged. These points will be accessed by the other players, and if there is a disagreement on the score, then the point scores of all of the players will be added and an average will be taken by dividing the sumed score points by the number of players voting. This final point score will then be rated in the above-mentioned manner.

In the foregoing description, a particular game has been illustrated and a particular type of style of game has been described. It will be understood, however, that the principles of the present invention are applicable to other types of games and game boards and different types of game pieces and the like may be employed while practicing the principles of the present invention. It will, therefore, be understood that it is desired to comprehend within the purview of the present invention all such modifications and adaptions thereof as may be considered to fall within the scope of the appended claims.

We claim:

1. A board game associated with a representation of an ecological system comprising a game board having an annular outer peripheral playing piece movement path divided into separate indicia bearing adjoining spaces having specific indicia designations thereon associated with preselected ecological situations, said designations indicating a task, reward, or penalty for players of the game; an annular inner peripheral playing piece movement path smaller in circumference than the outer path, concentrically located relative to the outer path, and cooperating with the outer path defining a peripheral space therebetween, the inner path being divided into separate indicia bearing adjoining spaces having specific indicia designations thereon associated with preselected ecological situations, said designations indicating a task, reward, or penalty for the players of the game; the peripheral space between the outer and inner paths being divided into separate indicia bearing circumferentially spaced-apart spaces having Start/Enter designations thereon for the players of the game, each Start/Enter space being in registration with a different one of the spaces of the outer path and in registration with a different one of the spaces of the inner path; a plurality of stacks of action cards associated with preselected spaces on said board, said preselected spaces referring a player to a specific stack of action cards, each of the cards of a stack including indicia thereon indicating a particular form of activity to which a player may be subjected, said stacks of cards being separated into individual stacks of cards, each stack of cards being identified by a different environmental category set forth on said game board, some of the spaces of the outer path being marked with indicia indicating different environment categories corresponding to the environmental categories of the stacks of cards associated with said environment category and some of the spaces of the inner path being marked with indicia indicating different environmental categories corresponding to the environmental categories of the associated stacks of cards, the spaces of the outer path not marked with indicia corresponding to the categories of the stacks of cards are marked with indicia specifying an instruction to be performed successfully by a player and some of the spaces of the inner path not marked with indicia corresponding to the categories of the stacks of cards are marked with indicia specifying an instruction to be performed successfully by a player; a plurality of playing pieces; and, a random number generating device for determining a number of spaces said playing pieces move along either the outer path, inner path, or over the Start/Enter space from the outer path to the inner path.

2. The board game of claim 1, wherein the outer path and inner path are divided into equal number of spaces, and each space of the inner path is in alignment with a different one of the spaces of the outer path across the peripheral space therebetween.

3. The board game of claim 2, wherein the number of Start/Enter spaces is less than the number of spaces of the outer path and the number of spaces of the inner path.

4. The board game of claim 3, wherein the spaces of the outer path have sequential numerals printed therein sequentially increasing in numerical value in either a clockwise or counter-clockwise direction of the outer path; and the spaces of the inner path have sequential numerals printed therein sequentially increasing in numerical value in the same sense of direction as the numerals in the spaces of the outer path.

5. The board game of claim 4, wherein the numerals in the spaces of the inner path begin with the next highest numerical value from the highest numerical value of the numerals of the outer path.

6. The board game of claim 1, wherein the cards of each stack of cards designate particular instructions relating to the categories of that stack relating to the environment which instruction must be followed successfully by a player drawing the card.

* * * * *